United States Patent [19]

Croy

[11] Patent Number: 4,829,275

[45] Date of Patent: May 9, 1989

[54] METHOD AND MEANS FOR PROVIDING CONSISTENT OPERATION OF A SOLENOID ACTUATOR

[76] Inventor: Dennis P. Croy, 545 Martindale, Milford, Mich. 48042

[21] Appl. No.: 211,822

[22] Filed: Jun. 27, 1988

[51] Int. Cl.[4] ..... H01F 7/13

[52] U.S. Cl. ..... 335/273; 335/258; 251/129.18; 251/129.2

[58] Field of Search ..... 335/258, 260, 262, 270, 335/273, 274; 251/129.15, 129.18, 129.2

[56] References Cited

U.S. PATENT DOCUMENTS 2,843,807 7/1958 Lewus ..... 335/273 X 4,763,091 8/1988 Lang ..... 335/258

*Primary Examiner*—George Harris

*Attorney, Agent, or Firm*—Robert G. Mentag

[57] ABSTRACT

A method for providing consistent response repeatability of a DC solenoid within a close time tolerance in the energized response time for moving the solenoid armature, and the means for carrying out the method.

5 Claims, 1 Drawing Sheet

METHOD AND MEANS FOR PROVIDING CONSISTENT OPERATION OF A SOLENOID ACTUATOR

BACKGROUND OF THE INVENTION

1. Technical Field

The field of art to which this invention pertains may be generally located in the class of devices relating to solenoid actuators. Class 335, Electricity, Magnetically Operated Switches, Magnets and Electromagnets, United States Patent Office Classification, appears to be the applicable general area of art to which the subject matter similar to this invention has been classified in the past.

2. Background Information

DC solenoid or electromagnetic actuators are used for actuating various apparatuses such as switches, valves and the like. A problem encountered in the operation of a DC solenoid actuator is one of repeatability of substantially the same energized response time of a solenoid actuator. Heretofore, the energized response time for a DC solenoid actuator could not be made consistent or repeatable, from one time compared to the next time, within a close tolerance. For example, if it took three milliseconds to respond to an energizing signal for one actuating movement of the armature of a DC solenoid actuator, it would take four or five milliseconds to respond to the next energizing signal. However, in some instances it is desirable to have a DC solenoid actuator respond to an energizing signal within a tolerance of plus or minus 0.3 milliseconds, while in other operations the solenoid actuator must respond with a repeatability of within 0.1 milliseconds in order to provide proper operation of the apparatus which the solenoid actuator is actuating. It is an object of the present invention to overcome the problem of response repeatability in the operation of a DC solenoid actuator, so as to provide a response repeatability with a minimum variation, as for example, plus or minus 0.1 millisecond.

SUMMARY OF THE INVENTION

It is the primary object of the present invention to provide a method and means for ensuring the consistent response repeatability of a DC solenoid actuator. It will be understood that a DC solenoid actuator can be used in any instance where an apparatus or instrumentality must be operated in a repeatable manner. A DC solenoid actuator includes amongst other elements a housing which carries a solenoid coil adapted to be connected to a source of electrical energy, and an armature operative movable within said coil. An apparatus which a DC solenoid actuator is adapted to operate has a movable operator which is engagable with the solenoid armature, and said apparatus includes means to normally urge said movable operator to a predetermined initial position which in turn moves the armature to a predetermined initial or de-energized position. In accordance with the present invention, a manual solenoid operator is slidably mounted in an adjustable, manual override bushing in a solenoid housing, and the manual solenoid operator is adjusted to a position in close proximity with the armature. The manual override bushing is threadably mounted in the solenoid housing and it is adapted to be retained in a desired adjusted position by a suitable locking means, such as a lock nut, or a thread locking compound applied to the threads of the threaded override bushing. The primary purpose of the adjustable override bushing is to take up the clearances and tolerances behind the armature.

The override bushing is adapted to be adjusted inwardly of the solenoid housing so as to move the manual solenoid operator inwardly until it engages the armature, so as to move the apparatus operator slightly. The override bushing is then adjusted backward or outward, until the manual solenoid operator allows the armature to be returned, by the means in the apparatus which moves the apparatus operator and the armature, to the initial de-energized armature position. The apparatus operator is then in a position whereby when the DC solenoid actuator is energized in a repetitive manner, it will operate the armature which in turn will operate the apparatus operator in a consistent repetitive action, within a very close tolerance of, for example, plus or minus 0.1 millisecond.

The invention is illustrated hereinafter in an embodiment which is employed for operating a three-way poppet valve. Although the illustrative embodiment employs a poppet type valve, it will be understood that the DC solenoid actuator of the present invention can also be used to actuate other type valves, and various apparatuses.

DESCRIPTION OF THE PREFERRED EMBODIMENT

Figure 1:
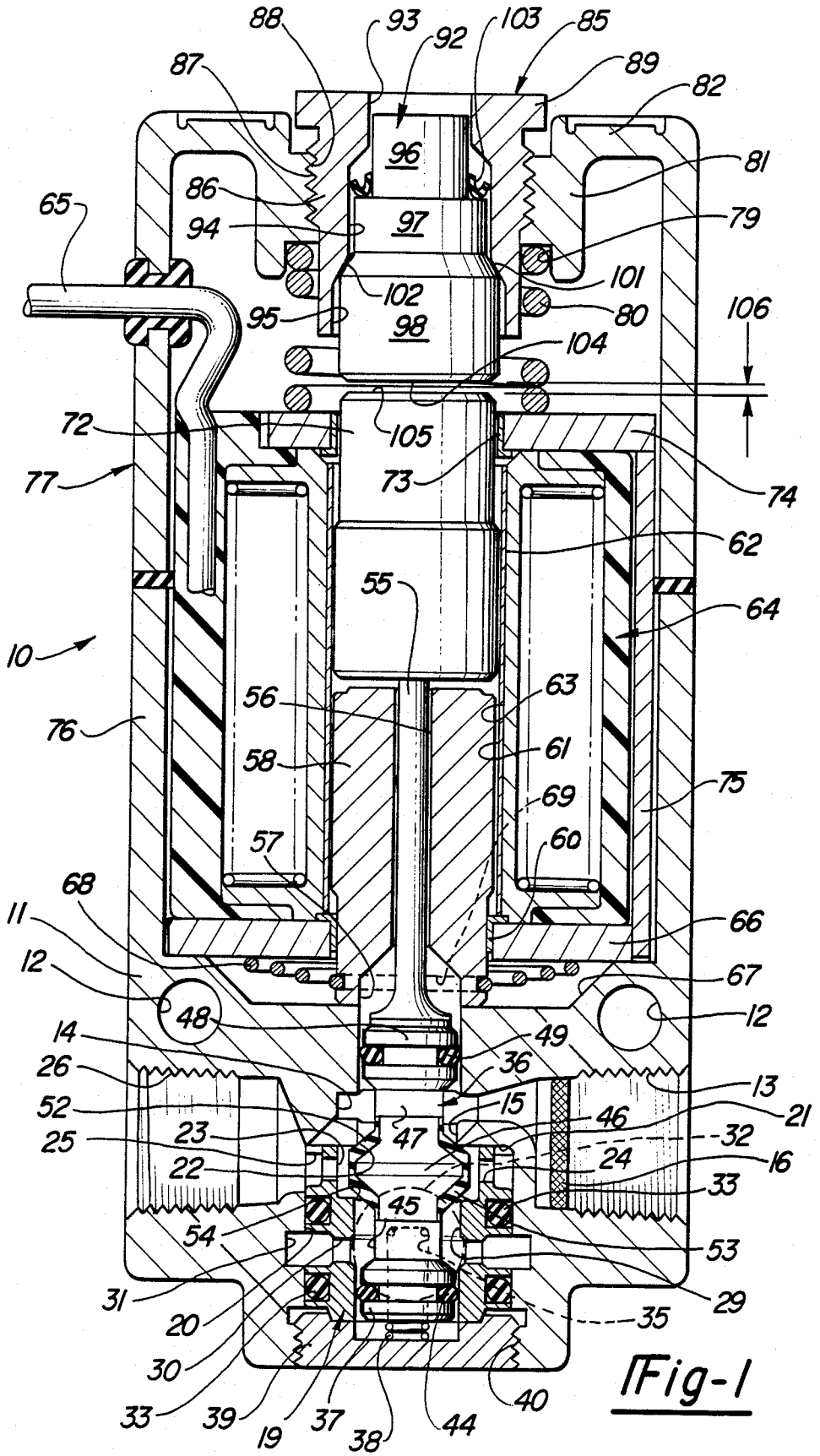
FIG. 1 is an elevation section view of a three-way valve operated by a DC solenoid actuator embodying the principles of the present invention.

Referring to the drawing, the numeral 10 generally designates a three-way valve having a valve body 11. The valve 10 may be used by itself or adapted to be operatively mounted on a fluid flow control valve to control, as for example, a four-way valve, a three-way valve, a two-way valve, and the like. The valve body 11 is provided with a pair of mounting holes 12 for the reception of suitable mounting bolts to mount the solenoid operated valve 10 in an operative position.

The valve 10 is provided with an air inlet port 13 which communicates with an annular groove 14 which is formed in the wall of an axial bore 15 that is formed in the valve body 11, perpendicular to the longitudinal axis of the inlet port 13. The numeral 16 designates an air filter screen operatively mounted in the air inlet port 13.

As shown in FIG. 1, a valve retainer, generally indicated by the numeral 19 is seated in an enlarged axial bore 20 in the valve body 11. The upper end of the bore 20 terminates at a transverse shoulder 21, at which point the inner end of the enlarged bore 20 communicates with the lower end of the enlarged bore 15 and forms a circular sharp edged valve seat 22. The valve retainer 19 has an inwardly extended axial bore 23 formed in the upper end thereof which communicates with the lower end of the axial bore 15 in the valve body 11. An annular groove 25 is formed around the outer periphery of the valve retainer 19. A plurality of aligned radial passageways 24 are formed through the side wall of the upper end of the valve retainer 19, and they communicate with the inner end of a transfer port 26 through the annular groove 25.

An axial bore 29 is formed in the valve retainer 19, and it extends upwardly from the lower end thereof and communicates at its upper or inner end with the larger diameter bore 23. A plurality of transverse bores or passageways 30 are formed through the lower end wall of the valve retainer 19, and they communicate at their inner ends with the axial bore 29, and at their outer ends with an annular groove 31 which is formed in the wall of the enlarged bore 20 formed in the lower end of the valve body 11. The annular groove 31 communicates with a transfer port which is positioned on the far side of the valve body 11, as illustrated in FIG. 1 by the broken line circle 32. A pair of O-rings 33 are operatively mounted in a pair of grooves formed around the lower outer periphery of the valve retainer 19, and they sealingly engage the bore 20 at positions above and below the annular groove 31.

A poppet valve spool, generally indicated by the numeral 36 is movably mounted in the valve body 11, with the lower portion thereof disposed in the valve retainer bores 23 and 29, and the upper portion thereof disposed in the valve body axial bore 15. The poppet valve spool 36 is provided with an elongated, substantially cylindrical body which has a lower end 37 slidably mounted in the lower end of the valve retainer bore 29. The poppet valve spool lower end 37 is seated against a valve spool return spring 38, which has an upper end seated in an axial bore 35 in the poppet valve spool lower end 37. The lower end of the return spring 38 is seated on a retainer plug 39 which is threadably mounted in an enlarged threaded bore 40 formed in the lower end of the valve body 11. The retainer plug 39 functions as a spring seat for the return spring 38. The lower end 37 of the poppet valve spool 36 has operatively mounted therearound an O-ring seal 44 which sealingly engages the bore 29 in the lower end of the valve retainer 19.

The lower end 37 of the poppet valve spool 36 is integral at its upper end with a reduced diameter portion 45. The poppet valve spool portion 45 is integral at its upper end with an annular enlarged diameter flange 46 which is integral with an upper reduced portion 47 that has a diameter equal to the diameter of the poppel valve spool portion 45. The poppet valve spool portions 45 and 47 are connected to the annular flange 46 by outwardly tapered portions, which converge outwardly toward the outer periphery of the flange 46 to form upper and lower, spaced apart, peripheral conical surfaces. The upper end portion 47 of the poppet valve spool 36 is integrally connected to an enlarged diameter portion 48, around which is operatively mounted an O-ring seal 49 which sealingly engages the upper end of the axial bore 15 in the valve body 11.

As shown in FIG. 1, a pair of annular, tapered, longitudinally spaced apart annular poppet valve members 52 and 53 are integrally molded, from a suitable elastomeric material, on the upper and lower conical peripheral surfaces above and below the poppet valve spool flange 46, respectively. The outer faces of the poppet valve members 52 and 53 are conically shaped and they converge toward each other. The adjacent ends of the annular poppet valve members 52 and 53 are integrally connected. The lower end of the annular poppet valve member 53 is connected to an integrally molded cylindrical extension of the same material from which the poppet valve member 53 is made, and it extends downwardly to a shoulder formed between the inner end of the poppet valve spool portion 45 and the lower end of the portion carrying the flange 46. The upper end of the poppet annular valve member 52 is connected to an integrally molded cylindrical extension of the same material from which the poppet valve member 52 is made, and it extends upwardly to a shoulder formed between the upper end of the poppet valve spool portion that contains the flange 46 and the lower end of the poppet valve portion 47.

As shown in FIG. 1, the return spring 38 normally biases the poppet valve spool 36 upwardly to the position shown in FIG. 1, with the upper, conical annular poppet valve member 52 in sealing engagement against the upper circular, sharp edged valve seat 22. The poppet valve spool 36 is shifted downwardly by the hereafter described solenoid structure, so as to move the lower, conical annular poppet valve member 53 downwardly into sealing engagement against the lower circular, sharp edged valve seat 54, which is formed by the junction of the upper end of the valve retainer bore 29 and the shoulder at the lower end of the larger diameter valve retainer bore 23.

As shown in FIG. 1, a poppet valve spool operator, comprising an elongated cylindrical shaft 55 is operatively mounted through an axial bore 56, and a communicating enlarged diameter bore 57, in a cylindrical pole piece 58. The diameter of the enlarged bore 57 is the same as the axial bore 15 in the valve body 11. The pole piece 58 is mounted in a bore 61 of a core guide 62 which is axially mounted in a bore 63 in a solenoid assembly, which is generally indicated by the numeral 64. The numeral 65 designates the lead wires for the coil assembly 64.

The lower end of the pole piece 58 is slidably supported in a bushing 60 which is operatively mounted in a transverse, lower annular flux plate 66. The lower end of the pole piece 58 is seated in a recess or chamber 67 that is formed in the upper end of the valve body 11. The pole piece 58 is biased into seating engagement with the inner end wall of the chamber 67 by an armature return spring 68 which has its upper end abutting the lower side of the flux plate 66 and its lower end operatively mounted in an annular groove 69 formed around the lower end of the pole piece 58.

A solenoid armature 72 is slidably mounted in the upper end of the core guide 62 and its upper end is slidably mounted through a bushing 73, which is centrally mounted in an upper annular flux plate 74. The previously described solenoid structure is enclosed by a solenoid tube 75, and an outer cylindrical housing 76 which has its lower end integral with the upper end of the valve body 11. A solenoid cover, generally indicated by the numeral 77, is mounted on the upper end of the solenoid housing 76 and is secured to the valve body 11 by suitable machine screws (not shown).

A load spring 80 is seated in the solenoid cover 77 and its upper end is seated in a groove 79 formed in a boss 81 which is integrally formed on the inner side of the end wall 82 of the solenoid cover 77. The lower end of the load spring 80 abuts the outer side of the upper annular flux plate 74.

An adjustable manual override bushing, generally indicated by the numeral 85, is adjustably mounted in the boss 81. The manual override bushing 85 includes a cylindrical bushing body 86 which has a threaded, outer periphery 87 that is threadably mounted in an axial threaded bore 88 formed through the boss 81. The manual override bushing 85 is provided with a transverse, outwardly extended flange 89 on the outer end thereof, for gripping the manual override bushing 85 to adjust said bushing axially, as described more fully hereinafter.

The threads on the manual override bushing periphery 87 and the threads for the threaded bore 88 in the boss 81 are fine threads, as for example a ½"-20 thread, to permit fine axial adjustment of the override bushing 85. A suitable thread locking compound is applied to the threads on the bushing periphery 87 and the threads in the threaded boss bore 88. The thread locking compound functions to hold the override bushing 85 in a desired adjusted position. It will be understood that other locking means could be employed for holding the bushing 85 in an adjusted position, as for example, a lock nut means.

A manual operator, generally indicated by the numeral 92, is slidably mounted in an axial, stepped bore formed through the override bushing 85. The stepped bore comprises an outer portion 93, an enlarged diameter portion 94, and a further enlarged diameter portion 95. The manual operator 92 includes a stepped cylindrical body comprising, an outer portion 96 which is slidably mounted in the stepped bore portion 93 in the override bushing 85, an intermediate portion 97 which is slidably mounted in the override bushing stepped intermediate bore portion 94, and an inner end portion 98 which is slidably mounted in the inner end stepped bore portion 95 in the override bushing 85. The manual operator intermediate portion 97 and inner end portion 98 are connected by a conically shaped, sloping portion 101, which is adapted to be seated on a complementary, conically shaped bore portion 102 which connects the stepped bore portions 94 and 95 in the override bushing 85. A suitable, annular, cup-shaped seal 103 is operatively mounted around the manual operator outer end portion 96 and it sealingly engages the stepped bore portion 94 in the override bushing 85. The manual operator 92 may be made from any suitable material as, for example, a suitable metal or molded plastic material.

In use, the inlet port 13 would be supplied with air under pressure. The pressurized air would be blocked from the transfer port 26 when the poppet valve spool 36 is in the position shown in FIG. 1, because the solenoid coil 64 is de-energized, and the upper annular poppet valve member 52 is seated against the upper circular sharp-edged valve seat 22 to block the flow of air from the inlet port 13. The transfer port 26 is open to the transfer port 32. When the solenoid coil 64 is energized, the armature 72 pushes down on the valve operator or shaft 55, to shift the poppet valve spool 36 downwardly, to block communication between the transfer ports 26 and 32, and to seat the lower poppet annular valve member 53 on the lower valve seat 54, whereby the inlet port 13 is open to the transfer port 26 to permit the flow of air through the annular groove 14, the bore 15, the radial passageways 24, the annular groove 25, and thence into the transfer port 26. When the solenoid coil 64 is de-energized, the poppet valve spool 36 is moved upwardly by the return spring 38 to return the poppel valve spool 36 to the initial position shown in FIG. 1. The last described upward movement of the poppet valve spool 36 connects the transfer port 26 through the retainer bore 29 to the transfer port 32.

In accordance with the invention, in order to provide consistent response repeatability in the operation of the valve 10, after the valve has been assembled, the override bushing 85 is rotated forwardly or inwardly of the housing or solenoid cover 77, so as to move the manual operator 92 inward to engage its inner end 104 with the outer end 105 of the armature 72. The rotative inward movement of the override bushing 85 is continued until the armature 72 moves the poppet valve spool 36 off of its initial position on the valve seat 22 to permit leakage of inlet air past the poppet valve spool 36. The override bushing 85 is then carefully rotated in the backward or outward direction until the return spring 38 moves the poppet valve spool 36 upwardly to a seating position on its seat 22, and to stop the leakage past the poppet valve spool 36. The override bushing 85 and the manual operator 92 will thus be in a position to permit consistent response repeatability when the solenoid coil 64 is energized. The numeral 106 indicates the final adjusted clearance between the manual operator 92, and the armature 72. The clearance 106 would be constant regardless of the position the valve 10 is mounted in, and the response repeatability of the valve would be consistent.

What is claimed is:

1. A method for providing consistent response repeatability of a DC solenoid actuator having, a housing and an armature for actuating an apparatus having a movable operator, and means to normally urge the movable operator in one direction to a predetermined initial position in engagement with one end of the armature when the solenoid actuator is de-energized, and wherein the armature moves the apparatus movable operator from the initial position to an apparatus operating position when the solenoid actuator is energized, comprising the steps of:

(a) providing the solenoid actuator with an adjustable manual solenoid operator for engaging the other end of the armature;

(b) adjusting the manual solenoid operator in one direction to engage the other end of the armature and move the armature and the apparatus movable operator from the initial position so that actuation of the apparatus commences; and, (c) then adjusting the manual solenoid operator in the opposite direction until actuation of the apparatus ceases.

2. The method of providing consistent response repeatability of a DC solenoid actuator as defined in claim 1, including the steps of:

(a) mounting the adjustable manual solenoid operator in an override bushing threadably mounted in the solenoid housing; and, (b) rotatively adjusting the position of the override bushing to adjust the manual solenoid operator in said one direction and in said opposite direction.

3. The method of providing consistent response repeatability in the operation of a DC solenoid actuator as defined in claim 2, including the steps of:

(a) locking the override bushing in an adjusted position.

4. A DC solenoid actuator having, a housing and an armature for actuating an apparatus having a movable operator and means to normally urge the movable operator in one direction to a predetermined initial position in engagement with one end of the armature when the solenoid actuator is de-energized, and wherein the armature moves the apparatus movable operator from the initial position to an apparatus operating position when the solenoid actuator is energized, including:

(a) means for providing consistent response repeatability in the operation of said DC solenoid actuator, comprising;

(1) an override bushing threadably mounted in the solenoid housing for forward and backward rotative movement to adjust the position of the override bushing; and, (2) a manual operator carried in the override bushing, for engaging the armature when the override bushing is rotated in a forward direction to move the armature in one direction until the armature moves the apparatus movable operator from said initial position so that actuation of the apparatus commences, and for allowing the armature to move in the opposite direction when the override bushing is rotated in a backward direction, until actuation of the apparatus ceases.

5. The DC solenoid actuator as defined in claim 4, including:

(a) locking means for holding the override bushing in an adjusted position.

* * * * *

UNITED STATES PATENT OFFICE

CERTIFICATE OF CORRECTION

Patent No. 4,829,275 Dated May 9, 1989

Inventor(s) Dennis P. Croy

It is certified that error appears in the above-identified patent and that said Letters Patent is hereby corrected as shown below:

Column 1, line 53 - "operative" should be --operatively--.
Column 3, line 41 - "poppel" should be --poppet--.
Column 5, line 56 - "poppel" should be --poppet--.

Signed and Sealed this

Second Day of January, 1990

*Attest:*

JEFFREY M. SAMUELS

*Attesting Officer* *Acting Commissioner of Patents and Trademarks*